US010925370B1

(12) United States Patent
Yeboah

(10) Patent No.: US 10,925,370 B1
(45) Date of Patent: Feb. 23, 2021

(54) APPARATUS FOR STYLING HAIR

(71) Applicant: Joseph Yeboah, Stanley, ND (US)

(72) Inventor: Joseph Yeboah, Stanley, ND (US)

( * ) Notice: Subject to any disclaimer, the term of this patent is extended or adjusted under 35 U.S.C. 154(b) by 295 days.

(21) Appl. No.: 15/956,846

(22) Filed: Apr. 19, 2018

(51) Int. Cl.
*A45D 24/00* (2006.01)
*A45D 2/00* (2006.01)

(52) U.S. Cl.
CPC ..... *A45D 24/007* (2013.01); *A45D 2002/006* (2013.01)

(58) Field of Classification Search
CPC ..... A45D 24/007; A45D 2002/006; A45D 2002/005; A45D 2024/005; A46B 9/023; A46B 7/02; A46B 7/06; A46B 13/00; A46B 13/02; A46B 13/023; A46B 2200/104
See application file for complete search history.

(56) References Cited

U.S. PATENT DOCUMENTS 4,580,585 A * 4/1986 Sapkus ..... A45D 2/00 132/212
5,816,271 A * 10/1998 Urso ..... A61C 15/047 132/322
2003/0075198 A1* 4/2003 Kim ..... A45D 2/00 132/210
2003/0230316 A1* 12/2003 Glucksman ..... A45D 2/00 132/212
2014/0102466 A1 4/2014 Malbrough

FOREIGN PATENT DOCUMENTS

EP 687 426 A1 * 6/1995

OTHER PUBLICATIONS

EPO Translation EP0687426A1 (Year: 1995).*

* cited by examiner

*Primary Examiner* — Rachel R Steitz
(74) *Attorney, Agent, or Firm* — Sanchelima & Associates, P.A.; Christian Sanchelima; Alexander J. Rodriguez

(57) ABSTRACT

An apparatus for styling hair is disclosed. The apparatus comprises a handle comprising a motor. The apparatus further comprises a comb head coupled to the handle. The apparatus further comprises a plurality of bristles coupled to the comb head. Each of the bristles comprises a bristle head provided in a honeycomb shape to receive hair. Each of the bristles rotate when the motor is operated to twist and braid the hair.

6 Claims, 6 Drawing Sheets

APPARATUS FOR STYLING HAIR

OTHER RELATED APPLICATIONS

The present application does not claim priority from any other application.

FIELD OF THE INVENTION

The present disclosure generally relates to a hair styling apparatus. More particularly, the present disclosure generally relates to an apparatus for twisting and braiding the hair and adding hair extensions.

DESCRIPTION OF THE RELATED ART

It is known that men and women enjoy a variety of hairstyles including braids and extensions. Braids are a hairstyle wherein hairs are twisted to create beautiful designs of hair. Braids and extensions may vary in size and diameter. Although an individual can create braid designs at home, the process of forming braids by hand is a time-consuming task. In addition, individually twisting each braid by hand can be physically burdensome to one's fingers.

Several designs have been proposed in the past to style hair. U.S. Application No. US20140102466 issued to Malbrough discloses a comb that is capable of twisting hair to form a hairstyle, such as braids. The comb is attached to a handle comprising a button that the user may press to rotate the comb in 360 degrees. The Malbrough has several problems including that hair not required to be braided may also get tangled in the process. The individual using the comb may have to physically pull out the hair that is required to braided in that instance. This may lead to delaying the process of forming braids.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention is to provide an apparatus for styling hair.

It is one object of present invention is to provide an easy way to twist and braid hair and add extensions.

It is one object of present invention is to provide an apparatus for styling hair. The apparatus comprises a handle comprising a motor. The apparatus further comprises a comb head coupled to the handle and a plurality of bristles coupled to the comb head. Each of the bristles comprises a bristle head provided in a honeycomb shape to receive hair. The bristles are made to rotate by operating the motor to twist and braid the hair.

It is another object of present invention to provide an apparatus for styling hair that is convenient, easy to use and is lightweight.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses an apparatus for styling hair. The apparatus comprises a handle comprising a motor. The apparatus further comprises a comb head coupled to the handle. The apparatus further comprises a plurality of bristles coupled to the comb head. Each of the bristles comprises a bristle head provided in a honeycomb shape to receive hair. Each of the bristles rotates when the motor is operated to twist and braid the hair.

Various features and embodiments of the apparatus for styling hair are explained in conjunction with the description of FIGS. 1-5B.

Figure 1:
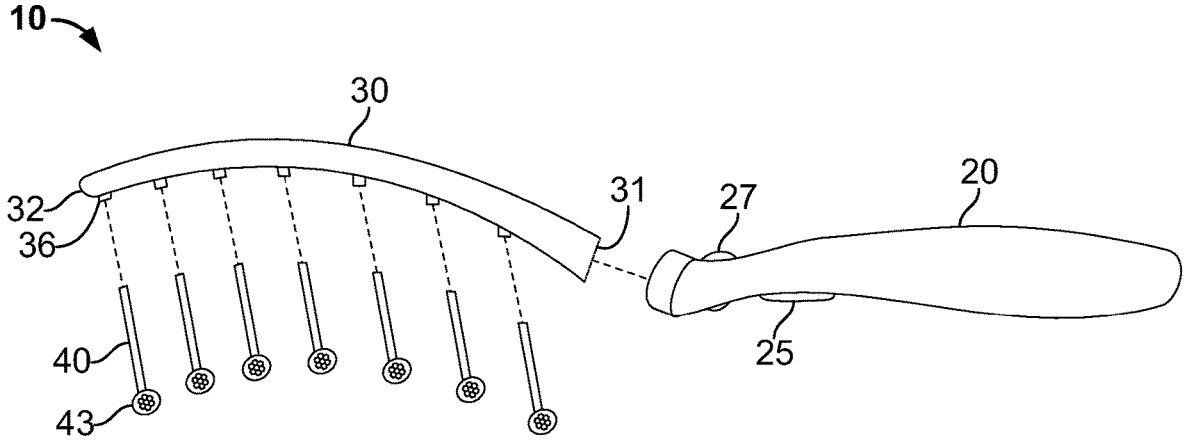
FIG. 1 illustrates an exploded view of an apparatus for styling hair, in accordance with one embodiment of the present disclosure.

Referring to FIG. 1, an exploded view of an apparatus 10 for styling hair is shown, in accordance with one embodiment of the present disclosure. The apparatus 10 comprises a handle 20, a comb head 30, and a plurality of bristles 40. Each of the handle 20, the comb head 30, and the plurality of bristles 40 may be made up of plastic or any other suitable material. The handle 20 and the comb head 30 are either removably assembled by an attachment mechanism or permanently connected to each other so that the present disclosure can be used by hairstylists or individuals to create dreadlocks, braids, or add extensions. The comb head 30 and the bristles 40 are removably assembled by an attachment mechanism explained below.

Figure 2:
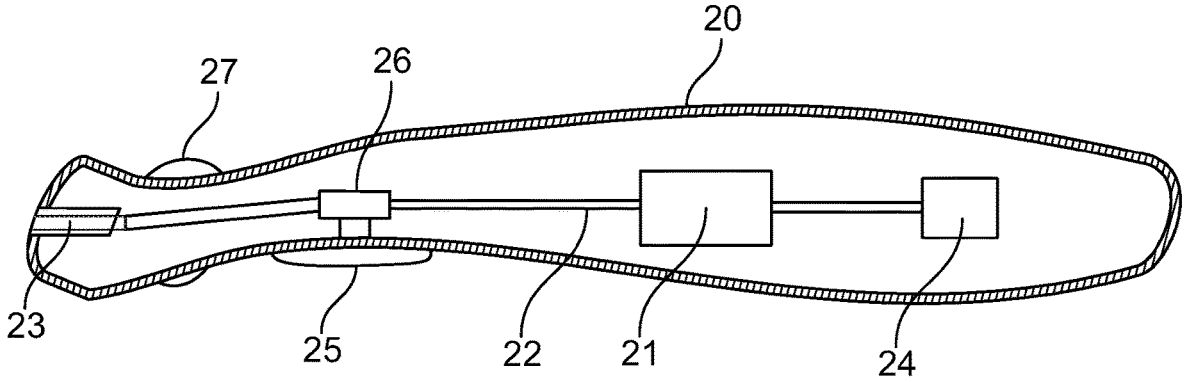
FIG. 2 illustrates a cross-sectional view of a handle to hold the apparatus, in accordance with one embodiment of the present disclosure.

Referring to FIG. 1, and FIG. 2, constructional features of the handle 20 is explained. FIG. 2 shows a cross-sectional view of the handle 20. The handle 20 may be provided in an oval shape or in cylindrical shape so that a user can hold the handle 20 with one hand. The handle 20 comprises a motor 21. The motor 21 comprises a motor shaft 22 that extends into mechanical communication with a chuck 23 rotatably mounted through an aperture (not shown) in the handle 20. The motor 21 is powered by a battery 24 contained within the handle 20. In one example, the battery 24 is a rechargeable battery. The batter 24 may be charged using known ports such as USB, AC adapter and so on. Although the current embodiment is presented to have the battery 24 to power the motor 21, it should be obvious to a person skilled in the art to connect the motor 21 to a power source such as an AC/DC source to run the motor 21. The motor 21 is operated using a switch 25 provided on the outer surface of the handle 20. In one example, the motor 21 is coupled to a speed controller 26 for controlling speed. The speed controller 26 may comprise a rheostat, potentiometer, or other speed control means is positioned in electrical communication with the motor 21 for controlling a rotational speed of the motor shaft 22. The handle 20 may further comprise a grip 27 made up of soft material such as a rubber. The grip 27 may be provided on outer surface of the handle 20. In use, the user of the apparatus 10 may hold the handle 20 at the grip 27 to style hair.

Figure 3:
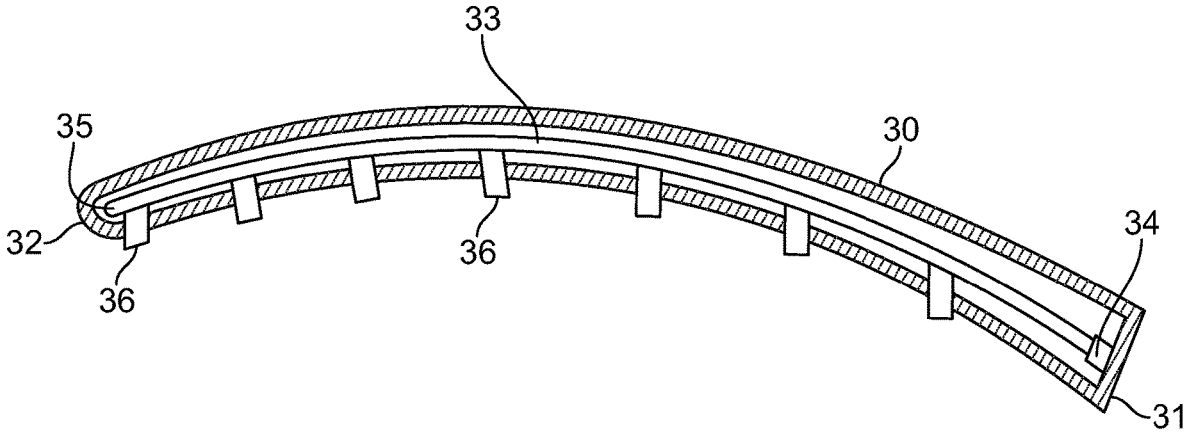
FIG. 3 illustrates a cross-sectional view of a comb head, in accordance with one embodiment of the present disclosure.

Referring to FIG. 1, and FIG. 3, constructional features of the comb head 30 is explained. FIG. 3 shows a cross-sectional view of the comb head 30. The comb head 30 comprises a first end 31 and a second end 32. The comb head 30 is coupled to the handle 20 at the first end 31 using a comb shaft 33 provided therein. The second end 32 is a free distal end. The comb shaft 33 comprises a first shaft end 34 and a second shaft end 35. The first shaft end 34 is coupled to the chuck 23 of the handle 20. The first shaft end 34 is coupled to the chuck 23 by means of a snap mechanism or using any other known mechanisms. The comb head 30 further comprises a plurality of openings (not shown) to provide connecting rings 36. The plurality of openings may be spaced at equal distance or at varied distance from one another. The connecting rings 36 are coupled to the comb shaft 33. The connecting rings 36 are configured to rotate in circular motion i.e., rotary motion when engaged by the comb shaft 33. In one implementation, each of the connecting rings 36 is configured to rotate in its own axis, which is different from other neighbor connecting rings. Specifically, one connecting ring is configured to rotate in clockwise direction and another connecting ring is configured to rotate in anticlockwise direction. In an alternate embodiment, all of the connecting rings 36 are configured to rotate in clockwise or anticlockwise direction.

Figure 4:
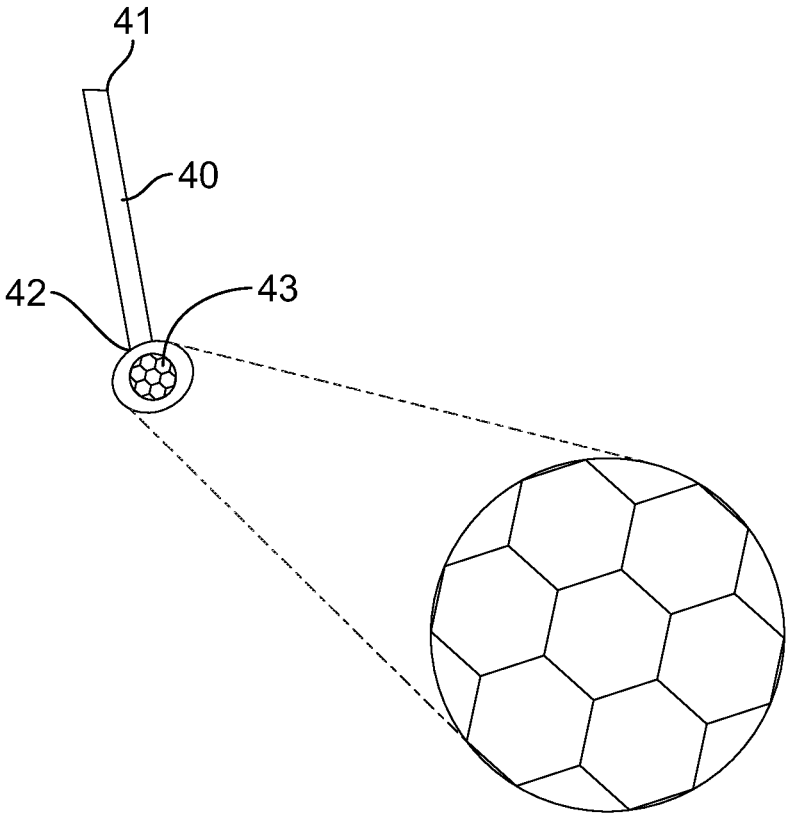
FIG. 4 illustrates a bristle, in accordance with one embodiment of the present disclosure.

Now referring to FIG. 1 and FIG. 4, construction of the bristles 40 is explained. Each of the bristles 40 comprises a first bristle end 41 and a second bristle end 42. The first bristle end 41 is coupled to the connecting rings 36 provided in the comb head 30. The first bristle end 41 may be coupled to the connecting ring 36 by means of a snap mechanism or using any other known mechanisms. Further, the second bristle end 42 comprises a bristle head 43. The bristle head 43 is provided in a honeycomb shaped as shown in FIG. 4. The user may place hair into the honeycomb shaped bristle head 43. The honeycomb shape provided at the bristle head 43 ensures that hair is firmly held.

Figure 5A:
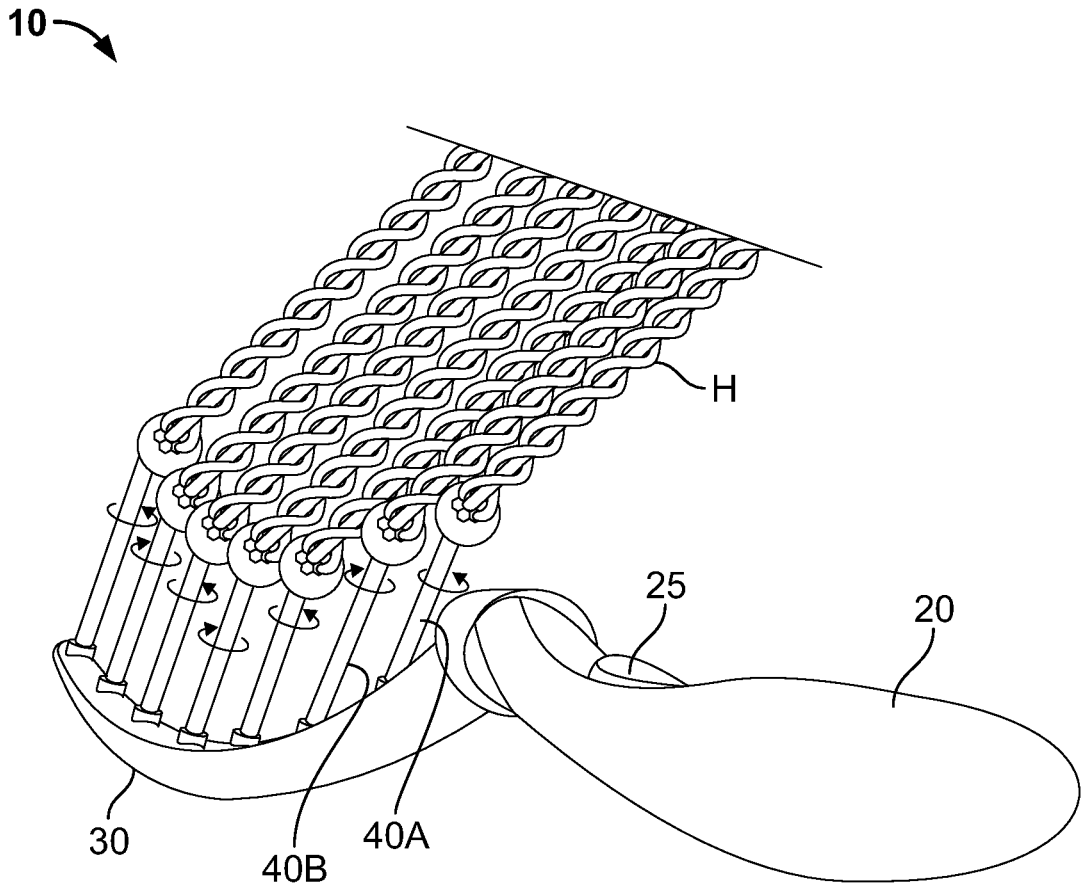
FIGS. 5A and 5B illustrate the apparatus for styling hair, in accordance with one embodiment of the present disclosure.
Figure 5B:
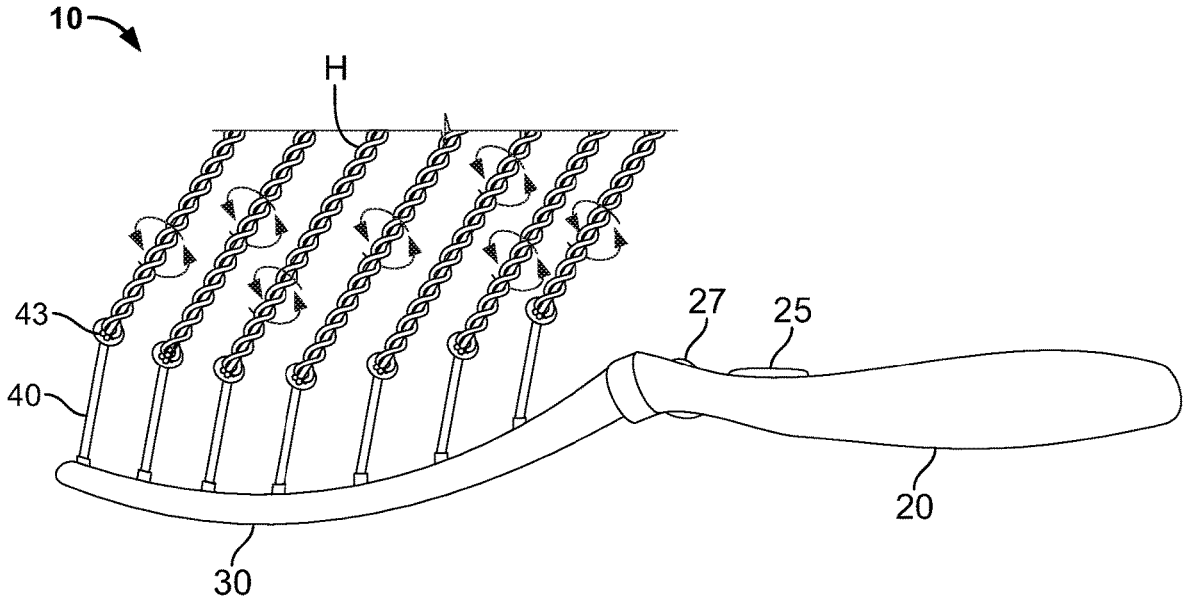

Referring to FIGS. 5A and 5B, a perspective view and a front view of the apparatus 10 used for styling hair H are shown, in accordance with one embodiment of the present disclosure. As described above, the bristles 40 are coupled to the comb head 30 via the connecting rings 36. Further, the comb head 30 is coupled to the handle 20.

In use, the apparatus 10 according to the present disclosure can be utilized to engage and rotate a lock of hair H into an elongated bundle configuration to form a braid hairstyle. Specifically, the user of the apparatus 10 places the hair H into the bristle head 43. Subsequently, the user activates the switch 25 provided on the handle 20. The switch 25 activates the motor 21, which draws power from the battery 24 to rotate the motor shaft 22. The motor shaft 22 in turn engages the chuck 23. Further, the chuck 23 engages the comb shaft 33. The comb shaft 33 rotates the connecting rings 36. As specified above, the connecting rings 36 rotate in own axis. Consequently, the connecting rings 36 rotate the bristles 40. In other words, when the user presses the switch 25, the bristles 40 rotate in rotary motion. As specified above, each of the bristles 40 may rotate in respective axis i.e., in circular motion. As such, referring to FIG. 5A, a first bristle 40A may rotate in anti-clockwise direction and a second bristle 40B may rotate in clockwise direction. Similarly, other bristles may rotate in clock and anticlockwise direction, respectively. When the hair H is placed at the bristle head 43, the bristle head 43 rotates thereby twisting the hair H and forms extensions or braids. The user may use extensions (not shown) to connect to the hair H of the user to increase the length of the braids. The user may control speed of the motor 21 using the switch 25, which in turn controls the rotation of the bristles 40.

It should be understood that the above description is provided as an exemplary embodiment of the present disclosure. As such, number of bristles 40 coupled to the comb head 30, length of the bristles 40, shape of the bristle head 43, and design of the apparatus 10 should not be taken in limited sense. For example, the apparatus 10 may be provided with a single bristle 40. The length of the bristle 40 may be short or long. Further, the shape of the bristle head 43 may be chosen in different shape other than the shape disclosed herein. As such, the apparatus 10 may be used to make a single strand. Further, the apparatus 10 may be used to make more than one strand i.e., in combination. As specified above, the shape of the bristle head 43 may be modified/changed in order to make small or big strands, as may be needed by the user.

The apparatus disclosed above provides a quick and easy way to twist and braid hair and add extensions. Further, the apparatus eliminates the need to manually braid hair. Furthermore, men or women alike may use the apparatus to twist and braid hair without any difficulty. The user of the apparatus may simply place the hair on the bristle head and operate the handle (motor) to twist hair into braids. Further, the honeycomb design provided at the bristle head helps in twisting hair and form braids. As the user can twist the hair without help from others, the user may form braids without visiting hairstylists. Furthermore, the apparatus may be used to form braids varied in size and diameter. In addition, the apparatus may be used to make single or combination of strands of various sizes. It should be noted that the apparatus is used to make strands that are neat, at much faster rate when compared to the strands made manually.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A apparatus for styling hair, comprising:

a) a handle including an interior space, said interior space containing a motor therein, a motor shaft coupled to said motor extending a length of said handle, wherein said motor shaft is coupled to a chuck rotatable mounted onto said handle, wherein said motor is coupled to a battery, wherein said battery is a rechargeable battery which receives as such from a USB port, a switch mounted to an outer surface of a front end of said handle, wherein said switch is coupled to a speed controller within said handle to control a rotational speed of said motor shaft, a grip provided at a top end of said handle, wherein said grip is a circular grip member made of a soft rubber material;

b) a comb head having a first end, a second end, and an interior portion, wherein said comb head is a thin and curved elongated structure, wherein said comb head is coupled to said handle, a comb shaft mounted within said comb head including a first shaft end and a second shaft end, wherein said first shaft end is coupled to said chuck of said handle through a snap mechanism, a plurality of connecting rings coupled to said comb shaft, said plurality of connecting rings being adjacently spaced apart along a side of said comb head, wherein said plurality of connecting rings are rotatable; and c) a plurality of bristles including a first bristle end and a second bristle end, wherein said first bristle end is coupled to said plurality of connecting rings of said comb head, a bristle head having a circular shape mounted to said second bristle end, wherein said bristle head includes a diameter larger than a diameter of said first bristle end, said bristle head having a honey comb shape.

2. The apparatus for styling hair of claim 1 wherein said plurality of bristles are provided as seven bristles.

3. The apparatus for styling hair of claim 1 wherein said plurality of connecting rings are provided as seven connecting rings.

4. The apparatus for styling hair of claim 1 wherein said handle has an oval shape.

5. The apparatus for styling hair of claim 1 wherein said handle has a cylindrical shape.

6. The apparatus for styling hair of claim 1 wherein said battery is contained entirely within said handle.

* * * * *